United States Patent [19]

Fox

[11] Patent Number: 4,759,089

[45] Date of Patent: Jul. 26, 1988

[54] CERVICAL PILLOW

[76] Inventor: Theodore A. Fox, 1170 Oak St., Winnetka, Ill. 60093

[21] Appl. No.: 43,627

[22] Filed: Apr. 28, 1987

[51] Int. Cl.[4] ..... A47C 20/02

[52] U.S. Cl. ..... 5/434; 5/436

[58] Field of Search ..... 5/431, 434, 436, 437, 5/440, 442

[56] References Cited

U.S. PATENT DOCUMENTS

| | | | |
|---|---|---|---|
| D. 204,443 | 4/1966 | Wood . | |
| D. 254,029 | 11/1980 | Barbagallo . | |
| D. 261,681 | 11/1981 | Chandler . | |
| 1,020,444 | 3/1912 | Platt . | |
| 1,349,072 | 8/1920 | Lines . | |
| 2,167,622 | 8/1939 | Bentivoglio | 5/434 X |
| 3,139,631 | 7/1964 | Kiefer | 5/440 |
| 3,156,500 | 11/1964 | Kerr | 5/436 X |
| 3,243,828 | 4/1966 | McCarty | 5/437 |
| 3,521,310 | 7/1970 | Greenawalt . | |
| 3,667,074 | 6/1972 | Emery . | |
| 3,753,264 | 8/1973 | Grenier . | |
| 3,757,364 | 9/1973 | Downing . | |
| 3,757,365 | 9/1973 | Kretchmer . | |
| 3,829,917 | 8/1974 | De Laittre . | |
| 3,842,453 | 10/1974 | Redfield . | |
| 4,218,792 | 8/1980 | Kogan . | |
| 4,320,543 | 3/1982 | Dixon | 5/436 X |
| 4,346,488 | 8/1982 | Eary, Sr. . | |
| 4,349,925 | 9/1982 | Macomber . | |
| 4,424,599 | 1/1984 | Hannouche . | |
| 4,432,107 | 2/1984 | Clark et al. . | |
| 4,494,261 | 1/1985 | Morrow . | |
| 4,550,458 | 11/1985 | Fiore . | |
| 4,550,459 | 11/1985 | Endel et al. . | |

*Primary Examiner*—Michael F. Trettel

*Attorney, Agent, or Firm*—Laff, Whitesel, Conte & Saret

[57] ABSTRACT

A theraputic pillow to support the head and neck of a user in a substantially horizontal resting position and particularly designed to relieve muscular pressure between the head and upper portion of the cervical spine, including a cradle element defined by a pair of lobes adapted to support the head of a user when placed in the cradle element, whereby the cradle element generally tapers downward from a rear portion of the pillow to a front portion of the pillow to hold the head in a position whereby the chin of the user is positioned towards the chest to relieve muscular tension between the head and neck of the user.

8 Claims, 1 Drawing Sheet

CERVICAL PILLOW

The present invention relates to theraputic pillows, and more specifically, to pillows designed to provide proper support for both the upper and lower portions of the cervical spine, for the prevention of tension of the neck muscles and ligaments.

BACKGROUND OF THE INVENTION

Many people suffer from neck pain, and pain related to problems with the neck. This fact is not surprising, considering that the head weighs between 10 and 20 pounds and must be balanced on the neck, which is more technically defined as the cervial spine. The balancing of the head is accomplished by the neck joint capsules or envelopes, ligaments, and especially by the neck muscles. When the relationship between the head, neck, and shoulders is altered, that is, when the individual's posture is incorrect, the muscle-ligament stabilization of the neck is inadequate, and muscles and ligaments are under tension, resulting in neck pain.

Many diverse factors cause or contribute to incorrect posture which causes neck pain. Trauma, (i.e. so-called whiplash injury), arthritis, and disc degeneration are just a few of the causes of neck pain. The most common cause of neck pain in adults is emotional stress or tension. The sustained and unrelenting contraction of the neck musles is a mechanism retained from primordial "flight or fight" reflexes.

Whatever the cause, whenever there is a sustained contraction of all of the neck muscles, the blood circulation in the neck muscles is diminished. The lack of adequate blood flow diminishes the oxygen supply of the muscles and diminishes the ability of the blood to wash out the waste products of the muscles, both of which are damaging. This condition can be aleviated by proper posture, where neck muscles and ligaments are relaxed, and not stretched.

Research has shown that the major cause of recurring neck discomfort, stiffness, and headaches is muscle tension or spasms in the cervical spine, caused or aggravated by incorrect sleeping posture. Presently available pillows are not designed to fully correct this problem.

During the day, to prevent neck pain and its resulting effects, such as headaches, a person must be constantly aware of his or her posture, or wear a cervical collar. At night, a properly constructed pillow can help relieve muscle constriction, and thus aid in relieving tension of the neck muscles and promote proper posture. Prior devices attempt to accomplish this result, but are not designed to relieve all of the tension associated with neck pain. U.S. Pat. No. 4,494,261, for example, is directed to a device to properly align the cervical spine. The pillow of U.S. Pat. No. 4,494,261, however, is designed to properly support only the lower cervical spine and not the upper.

Many prior art pillows do not provide for comfort of the user if the user is lying sideways. For example, if the user of the pillow disclosed in U.S. Pat. No. 4,494,261 were to lie on the side, the head would sink below the level of the ridge of the pillow and cause misalignment of the neck from the standpoint of relieving pressure on the neck muscles. The pillow structure of U.S. Pat. No. 3,829,917, as another example, provides support for the head while sleeping sideways, but is designed to stretch the neck muscles of the user while sleeping, rather than relieving muscular tension.

BRIEF SUMMARY OF THE INVENTION

It has been discovered that a slight tilt of the chin toward the chest while sleeping will help align the upper cervical spine and relieve tension and thereby relax the neck muscles which extend to the head. An object of this invention, therefore, is to provide a pillow which, when supporting a person's head, aligns both the upper and lower cervical spine by holding the head so as to encourage the chin to be directed towards the chest while at the same time maintaining the proper alignment of the lower cervical spine. Through research, it has been shown that maintaining the head at an angle of approximately 10° from horizontal will provide a proper tilt of the head toward the chest, and relieve tension on the muscles connecting the upper cervical spine to the head.

It is a further object of the present invention to provide a pillow for proper support of the head with the chin directed towards the chest whether the user is lying on his or her back or on the side.

DESCRIPTION OF THE PREFERRED EMBODIMENT

Referring to FIGS. 1–6, the cervical pillow of the present invention is generally designated by the numeral 10, with phantom lines showing the various construction sections of the superstructure. The cervical pillow is of such dimensions that it will fit into a standard size pillow case.

Figure 1:
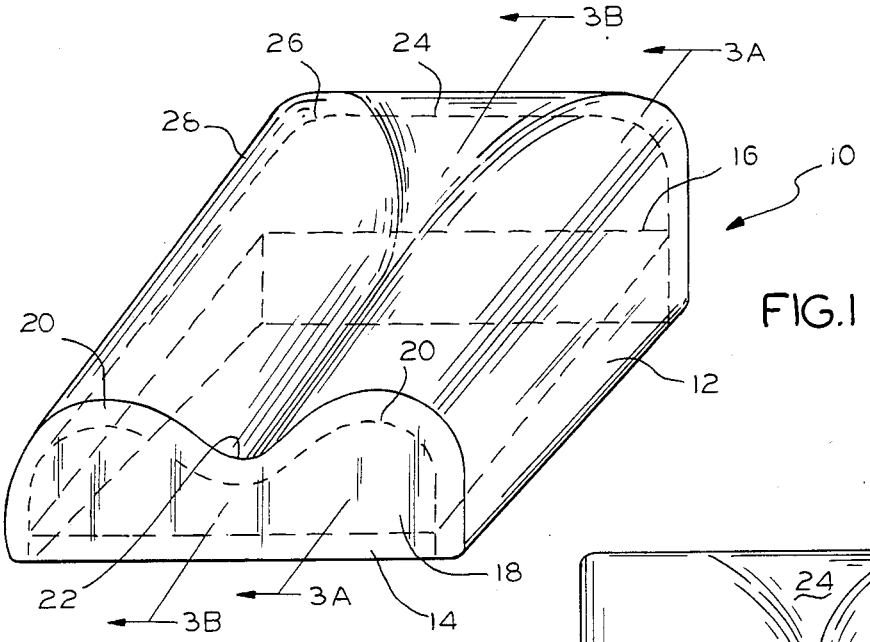
FIG. 1 is a perspective view of a cervical pillow embodying the present invention.
Figure 2:
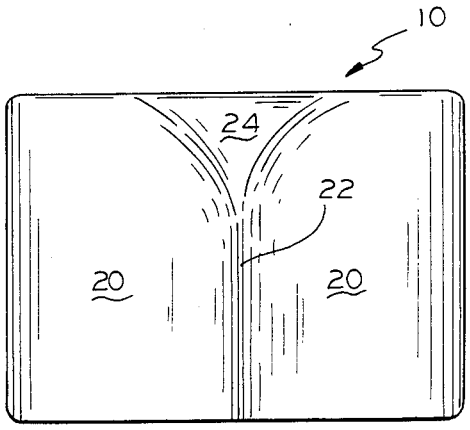
FIG. 2 is a top plan view of the pillow of FIG. 1.

In the preferred embodiment, the pillow 10 comprises a base element 12 made of resilient foam-rubber material, such as flexible polyurethane foam in density ranges of 0.9 to 3 pounds per cubic foot. The forward wall 14 of base element 12 is shorter in height than rear wall 16 of the base element, providing a taper downward from the rear to the front of base element 12. A contoured section 18 of polyurethane foam material is supported on base element 12, and comprises a pair of lobes 20 with a cradle element 22 defined between the lobes 20. Contoured section 18 is preferably of uniform dimensions along its length, and cradle element 22 between lobes 20 extends along and follows the taper of base element 12, as seen in FIGS. 1, 3A, and 3B.

A wedge section 24 of polyurethane foam is positioned on top of contoured section 18 adjacent the rear of cradle element 22, and tapers generally upwardly along the outer surfaces of lobes 20 from approximately the middle of cradle element 22 toward the rear of the pillow. The space between lobes 20 and in front of wedge 24 forms a cavity section of cradle element 22 which is adapted to support the head, as will be described.

To provide comfort for the user, the lateral and upper surfaces of the above-described pillow superstructure are covered with a top layer 26 of convoluted foam. Top layer 26 follows the contour of lobes 20, wedge 24, and generally defines the taper extending from the rear to the front of the pillow. The pillow construction is optionally completed by enclosing the above constructed polyurethane foam assembly into a zippered cover 28.

Figure 3A:
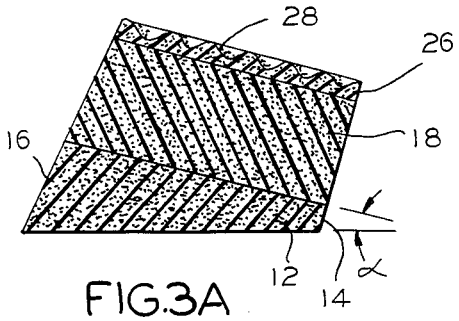
FIG. 3A is a cut-away section of the pillow of FIG. 1, taken along the line 3A—3A.
Figure 3B:
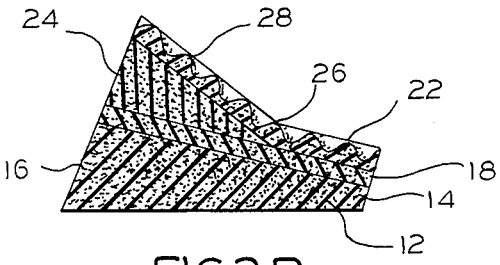
FIG. 3B is a cut-away section of the pillow of FIG. 1, taken along the line 3B—3B.
Figure 4:
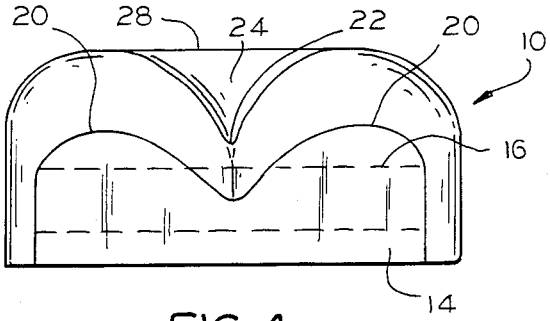
FIG. 4 is a front elevation view of the pillow of FIG. 1, with phantom lines showing the various parts of the pillow superstructure.
Figure 5:
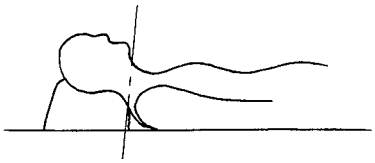
FIG.5 (PRIOR ART)
FIG. 5 is a schematic view of the relative position of the cervical spine and head supported by a prior art pillow.
Figure 6:
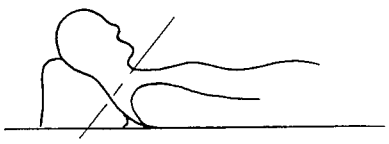
FIG. 6 is a schematic view of the relative position of the cervical spine and head supported by the pillow of the present invention.

It has been discovered that a taper angle of approximately ten degrees (10°), designated $\alpha$ in FIG. 3A, produces the optimum position for supporting the head when a person is asleep. In this position, with the head supported in the cavity formed in cradle element 22 between lobes 20 and in front of wedge 24, the taper of the cradle element holds the chin towards the chest, and muscular tension between the head and the upper cervical spine is relieved, as illustrated in FIG. 6. FIG. 5 illustrates the position of the head and upper cervical spine in pillows which do not have a taper from rear to front as does the presently disclosed pillow.

The pillow 10 of the present invention is also adapted to support a persons head with the chin towards the chest even when the person is sleeping in a sideways position. The back to front downward taper of the pillow construction will hold the head in such a position that when lying sideways, the head will tend to lay forward in the cradle element 22 at the angle of the taper whereby the weight of the head will cause the chin to be advanced toward the chest, thereby relieving muscular tension between the head and the upper cervical spine.

From the foregoing description, it is apparent that the present invention provides a cervical pillow that properly and comfortably supports the head and cervical spine of the user in either the supine or the side position, while relieving muscular tension between the head and upper cervical spine. While the preferred embodiment of the present invention has been described, it should be understood that various changes, modifications and adaptations may be made therein without departing from the spirit of the invention and the scope of the appended claims.

I claim:

1. A therapuetic pillow to support the head and neck of a user in a substantially horizontal resting position, said pillow including:

a rear portion having a fixed height and a front portion having a height lesser than said fixed height;

a cradle element defined between a pair of lobes, said cradle element adapted to support the head of a user when placed in said cradle element;

said lobes each having a curvalinear transverse section, which form a curved upper surface, the radius of curvature of each said lobe upper surface section diminishing from the rear portion of said pillow to said front portion thereof;

said cradle element generally tapering downward from said rear portion of said pillow to said front portion of said pillow to hold said head in a predetermined position with the chin of the user being positioned towards the chest to relieve muscular tension between the head and neck of the user.

2. The therapuetic pillow of claim 1 wherein said cradle element is supported by a base element, said base element having a forward wall and a rear wall, said base element tapering downward from said rear wall to said forward wall to provide said downward taper for said cradle element.

3. The therapuetic pillow of claim 1 wherein said cradle element tapers from said rear portion to said front portion of said pillow at an angle of substantially ten degrees from horizontal.

4. The therapuetic pillow of claim 1 including a layer of convuluted foam overlying said cradle element.

5. A therapuetic pillow to support the head and neck of a user in a substantially horizontal resting position, said pillow including:

a cradle element defined between a pair of lobes, said cradle element adpated to support the head of a user when placed in said cradle element;

said cradle element generally tapering downward from a rear portion of said pillow to a front portion of said pillow to hold said head in a position where the chin of the user is positioned towards the chest to relieve muscular tension between the head and neck of the user;

said pillow further including a wedge element located in said cradle element and extending from said rear portion of said pillow to a point substantially the midpoint intermediate the front and rear portions of said cradle element which defines said pillow, said wedge element having an upper surface that tapers substantially downward from said rear portion of said pillow to said midpoint of said cradle element and along portions of said lobes, the portion of said cradle element extending from said front portion of said pillow to substantially said midpoint of said pillow and forward of said wedge element is tapered a lesser amount than said wedge and adapted to support said head and neck.

6. A therapuetic pillow to support the head and neck of a user in a substantially horizontal resting position, said pillow including:

a rear portion and a front portion;

a base element having an upper surface, a forward wall, and a rear wall, said upper surface tapering downward from said rear wall to said front wall;

a contoured section supported by said upper surface of said base element and extending substantially from said front wall to said rear wall, said contoured section including a pair of lobes defining a cradle element between said lobes, said cradle element being supported by said base element at an angle corresponding to said taper;

a wedge shaped section disposed between a section of said tapered base element and said cradle element and extending from said rear portion of said pillow to a point intermediate said front and said rear walls defining substantially the midpoint of said cradle element and along a similar portion of said lobes, said wedge element having an upper surface that tapers substantially downward from the rear portion of said pillow to substantially said midpoint of said cradle element, whereby the section of said cradle element extending from said front portion of said pillow to substantially said midpoint of said pillow and forward of said wedge element is adapted to support said head and neck.

7. The therapuetic pillow of claim 6 including a layer of convoluted foam material extending over said contoured section, said upper surface of said wedge element, and lateral sides of said base element.

8. The therapuetic pillow of claim 6 wherein said taper of said upper surface of said base element from said rear wall to said front wall is ten degrees from horizontal.

* * * * *